US007140568B2

(12) United States Patent
Greisedieck et al.

(10) Patent No.: US 7,140,568 B2
(45) **Date of Patent: *Nov. 28, 2006**

(54) MULTI-SIDED SHAFT FOR A CRUSHER

(75) Inventors: Chris Greisedieck, St. Louis, MO (US); Steve Rogan, St. Louis, MO (US)

(73) Assignee: American Pulverizer Co., St. Louis, MO (US)

( * ) Notice: Subject to any disclaimer, the term of this patent is extended or adjusted under 35 U.S.C. 154(b) by 67 days.

This patent is subject to a terminal disclaimer.

(21) Appl. No.: 10/365,746

(22) Filed: Feb. 14, 2003

(65) Prior Publication Data

US 2003/0127549 A1 Jul. 10, 2003

Related U.S. Application Data

(63) Continuation-in-part of application No. 10/120,709, filed on Apr. 11, 2002, now Pat. No. 6,729,566.

(60) Provisional application No. 60/284,096, filed on Apr. 17, 2001.

(51) Int. Cl.
*B02C 13/04* (2006.01)
*B02C 13/13* (2006.01)

(52) U.S. Cl. ..... 241/194; 241/73; 241/189.1; 241/189.2; 241/195

(58) Field of Classification Search ..... 241/73, 241/189.1, 194, 195, 189.2
See application file for complete search history.

(56) References Cited

U.S. PATENT DOCUMENTS

| | | | | | |
|---|---|---|---|---|---|
| 4,519,551 | A * | 5/1985 | Ceurvorst | 241/194 |
| 4,690,340 | A * | 9/1987 | Hatanaka | 241/236 |
| 5,027,491 | A * | 7/1991 | Sidney et al. | 492/21 |
| 5,443,216 | A * | 8/1995 | Lajoie | 241/194 |
| 5,799,887 | A * | 9/1998 | Kroger | 241/236 |
| 6,357,680 | B1 * | 3/2002 | Irwin | 241/36 |
| 6,527,210 | B1 * | 3/2003 | Mecklenfeld | 241/194 |

* cited by examiner

*Primary Examiner*—Derris H. Banks
*Assistant Examiner*—Jason Y. Pahng
(74) *Attorney, Agent, or Firm*—Paul M. Denk

(57) ABSTRACT

A shredder, crusher, hammermill, ringmill or the like is provided with a multi-sided rotor shaft to which spider arms and hammers are mounted. The rotor shaft has at least one pair, and preferably two or more pairs, of opposing sides. The hammers are pivotally mounted between supports in the shape of spiders or discs. The supports include openings which have straight sides corresponding to the number of straight sides on the rotor shaft. The straight sides of the support openings engage the rotor shaft straight sides. Hence, the supports are rotationally fixed in place relative to the rotor shaft without the use of keys and keyways, pins, bolts, or other types of fasteners, allowing for easier assembly and reduced maintenance costs for the crusher.

4 Claims, 5 Drawing Sheets

MULTI-SIDED SHAFT FOR A CRUSHER

CROSS-REFERENCE TO RELATED APPLICATIONS

This application is a continuation-in-part of application Ser. No. 10/120,709 entitled Multi-Sided Shaft For A Crusher filed Apr. 11, 2002, U.S. Pat. No. 6,729,566 which in turn, claims benefit of provisional application Ser. No. 60/284,096 filed Apr. 17, 2001.

STATEMENT REGARDING FEDERALLY SPONSORED RESEARCH OR DEVELOPMENT

Not Applicable.

BACKGROUND OF THE INVENTION

This invention relates to crushers, such as shredders, hammermills and ringmills used to process ferrous and non-ferrous scrap material, and, in particular, to an improved rotor shaft for use with the crusher/shredder.

Crushers, shredders, hammermills, ringmills, and the like, are often used to process scrap material and stone, to crush or reduce the size of the material so that it can more easily be handled by other equipment for further processing or use.

Such crushers typically include a plurality of hammers or rings mounted about a rotatable shaft. As the shaft rotates, the hammers or rings engage and crush whatever media is introduced into the crusher. The hammers or rings can be mounted between supports in the form of spiders or center discs which are positionally fixed relative to the rotor shaft. Typically, the rotor shaft is cylindrical. The use of a cylindrical shaft requires that the supports be positively keyed to the shaft, for example, using a square or rectangular key on the support and a corresponding keyway on the shaft, so that the support cannot rotate relative to the shaft. The use of a keyway weakens the main shaft and makes removal of the supports and end discs a much more difficult task. Further, the key will weaken over time, and eventually the rotor assembly will shift between the shredder housings. Obviously, this can necessitate a repair of the crusher/shredder, requiring that operation of the crusher/shredder be stopped for the duration of the repair. Depending on the location of the support which is no longer positively fixed with respect to the shaft, the crusher/shredder can be shut down for a considerable period of time.

BRIEF SUMMARY OF THE INVENTION

A shredder, crusher, hammermill, ringmill or the like is provided with a multi-sided rotor shaft to which spider arms and hammers are mounted. The rotor shaft has at least at least one pair, and preferably two or more pairs, of opposing sides. The hammers or rings are pivotally mounted between supports, which take the form of spider arms and center discs. The supports have central openings which have straight sides corresponding to the number of straight sides on the rotor shaft. The straight sides engage the rotor shaft straight sides. Hence, the supports are rotationally fixed in place relative to the rotor shaft without the use of a central key, or other types of fasteners, allowing for easier assembly and reduced maintenance costs for the shredder/shredder.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes what I presently believe is the best mode of carrying out the invention.

Figure 1:
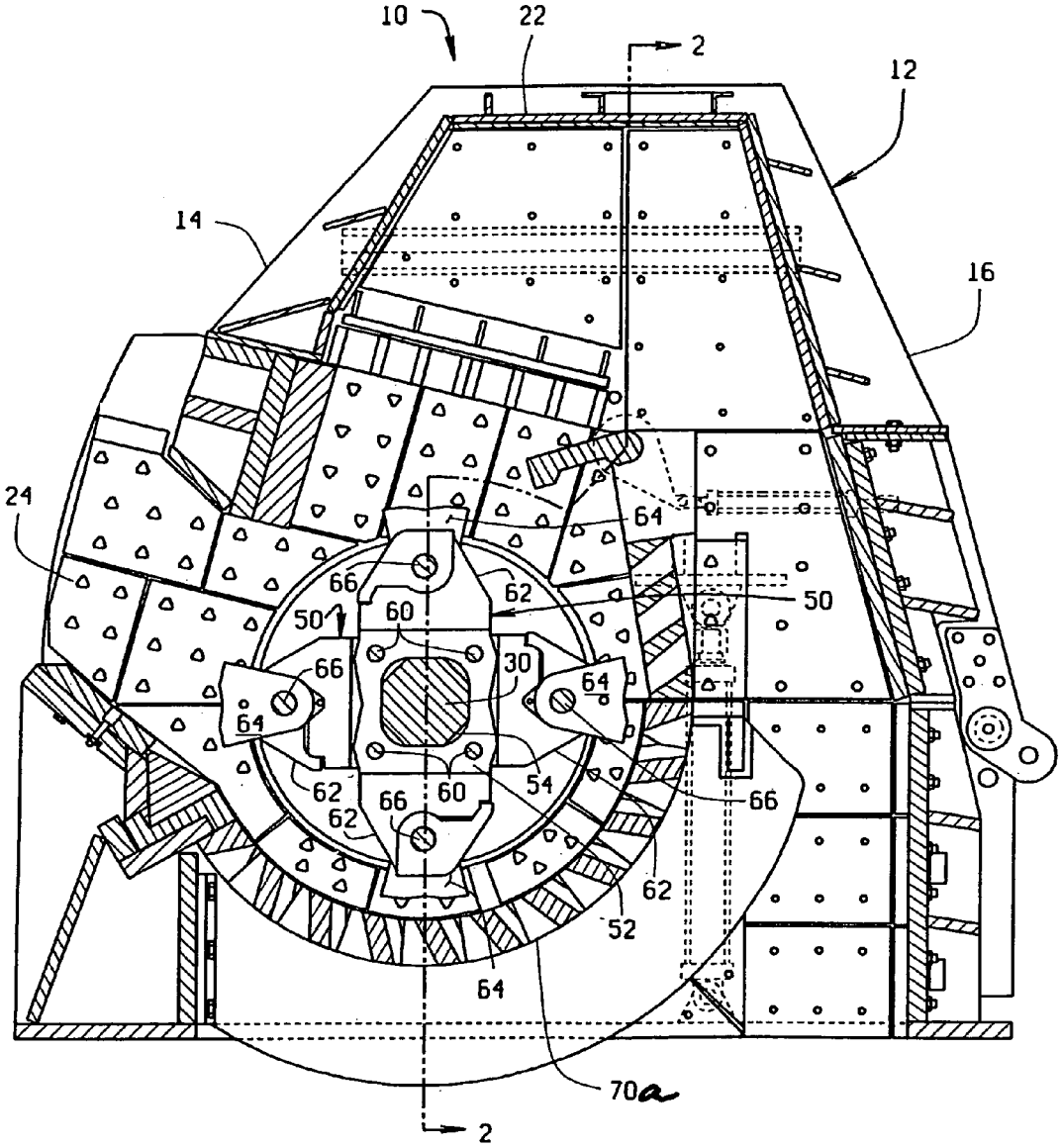
FIG. 1 is a cross-sectional view of a crusher having a shaft of the present invention taken along line 1—1 of FIG. 2.
Figure 2:
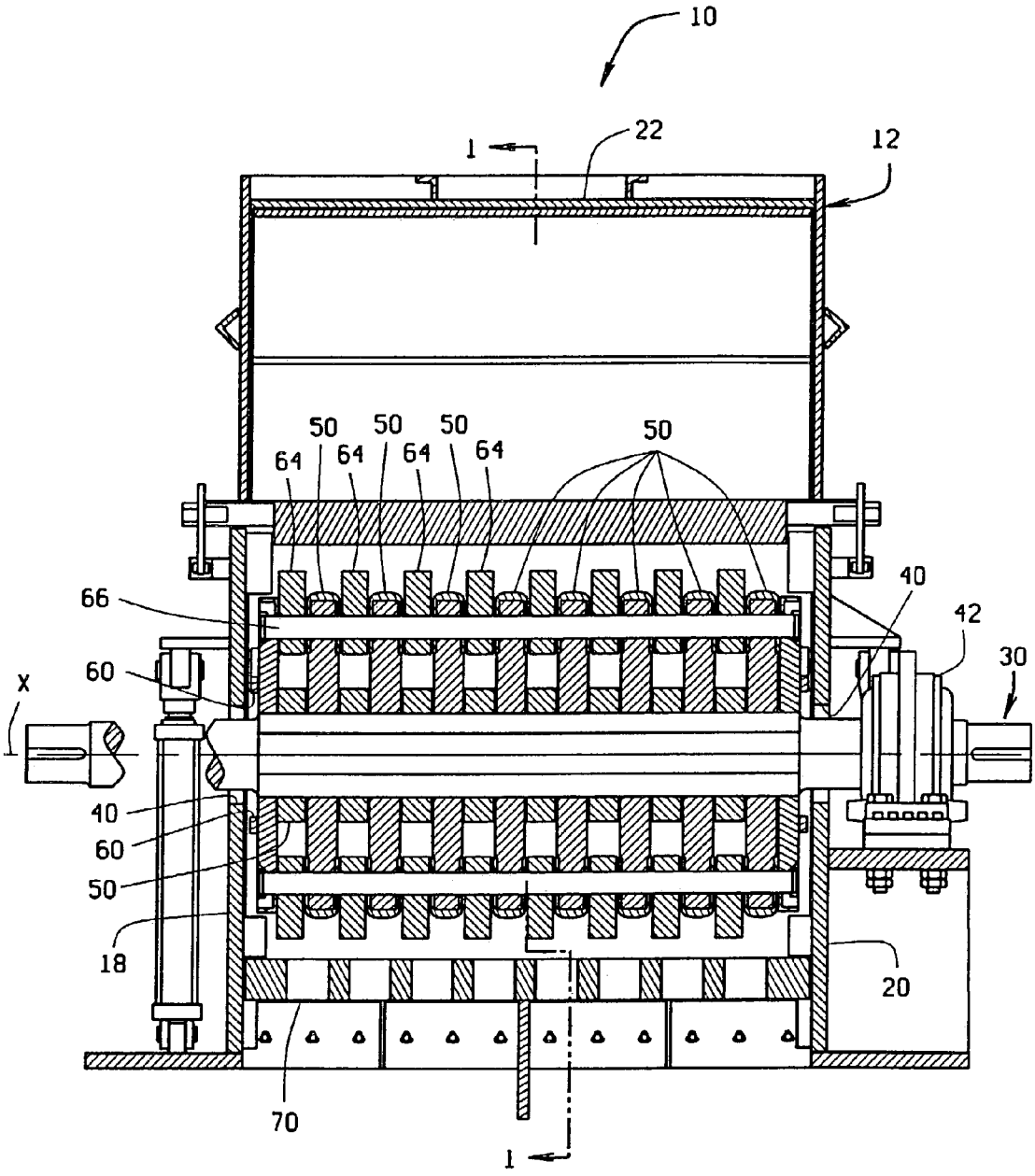
FIG. 2 is a cross-sectional view of the crusher taken along line 2—2 of FIG. 1.

A crusher 10 is shown generally in FIGS. 1 and 2. The crusher 10 includes a housing 12 having a front wall 14, a back wall 16, side walls 18 and 20, and a top 22. A feed inlet 24 is formed in the front wall. The feed inlet 24 can extend only a portion of the side-to-side width of the crusher 10, or can extend substantially the full side-to-side width of the crusher 10.

Figure 3:
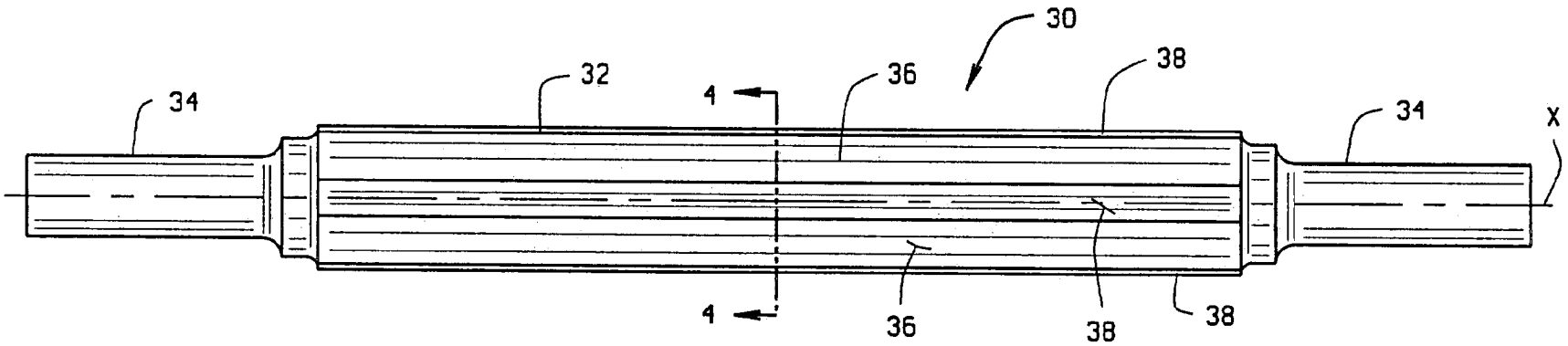
FIG. 3 is a side elevational view of the shaft.
Figure 4:
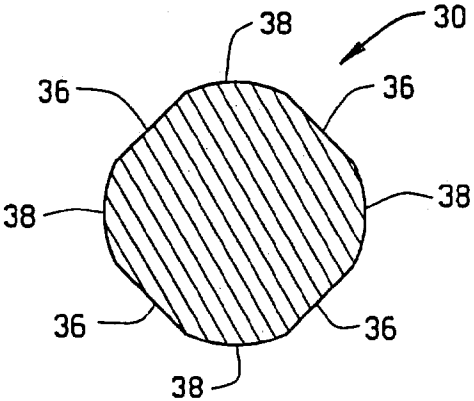
FIG. 4 is a cross-sectional view of the shaft taken along line 4—4 of FIG. 3.

A rotor or shaft 30 extends between the side walls 18 and 20 to rotate within the housing. As seen in FIGS. 3 and 4, the rotor 30 includes a multi-sided central section 32 and two cylindrical end sections 34 extending from opposite sides of the central section. The central section 32 has eight sides, however, it could be formed with fewer sides or more sides, as desired. The central section 32 as shown in FIG. 4 includes four long sides 36 which are angled generally 90° to each other and four short sides 38 positioned between the long sides 36, and which are also angled generally 90° to each other. The short sides 38 are curved and define arcs of a circle. Thus, in cross-section, the rotor central section 32 can be defined as a circle which is flattened along four sides to form the long sides 36. Alternatively, the central section 32 can be defined as a square in which the corners are truncated or beveled; the beveled or truncated sections forming the curved short sides 38. The ends 34 of the rotor 30 extend through openings 40 in the side walls 18 and 20. At least one end of the rotor 30 is in a bearing assembly 42, to allow the rotor to rotate within the housing 12. The other end 34 of the rotor 30 can be operatively connected to, and supported by, a drive, such as a motor to rotate the shaft along its axis X.

A plurality of supports 50 are positioned on the rotor central section 32. The supports, which, illustratively, are in the form of spiders, have a generally square base 52 having with a central opening 54. The opening 54 is a generally square opening having straight sides 56 and curved, rather than sharp, corners 58. The square opening 54 of the spider support is sized to fit over the rotor central section, such that the central section long sides 36 are adjacent the straight sides of the square opening 54. Rods 60 (FIG. 2) extend transversely through openings in the bases 52 to hold the spiders 50 together on the rotor 30. A pair of arms or mounts 62 extends from opposite sides of each spider base. The arms 62 of adjacent spiders alternate, such that one set is vertical, the next is horizontal, the next is vertical, etc. Hammers or rings 64 are mounted between adjacent spiders which extend in the same direction. A hammer shaft 66 (FIG. 2) extends through the arms 62, and the hammers/rings 64 are journaled on the shafts 66. As can be appreciated, the hammers/rings are positioned at intervals of 90° around the circumference of the rotor shaft 30. The rotor shaft could be provided with more than two pair of opposing straight sides to reduce the interval between the hammers/rings. For example, if the rotor shaft had three pair of opposing straight sides, the hammers/rings could be spaced at intervals of 60° around the shaft. Four pair of opposing straight sides would allow for intervals of 45° between the hammers/rings. Alternatively, the rotor shaft could be formed with only one pair of opposing straight sides, such that the hammers/rings are positioned 180° apart from each other. This would require the use of spacers between the rings/spider arm bases.

Figure 5:
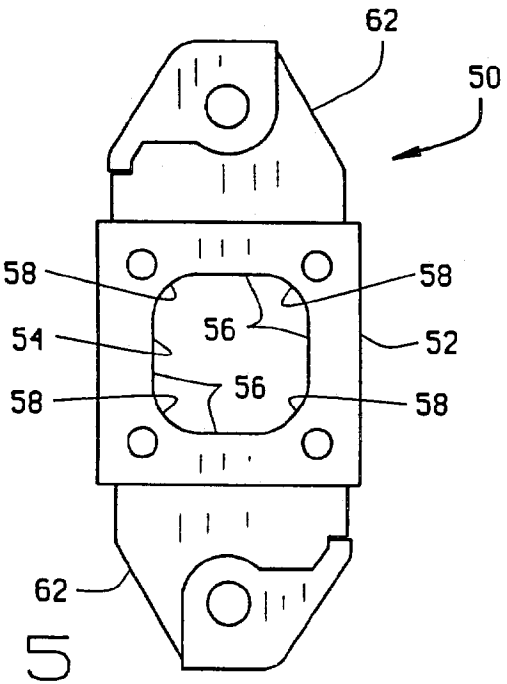
FIG. 5 is a plan view of a support in the form of a spider which is mounted on the shaft to support hammers in the crusher/shredder.
Figure 8:
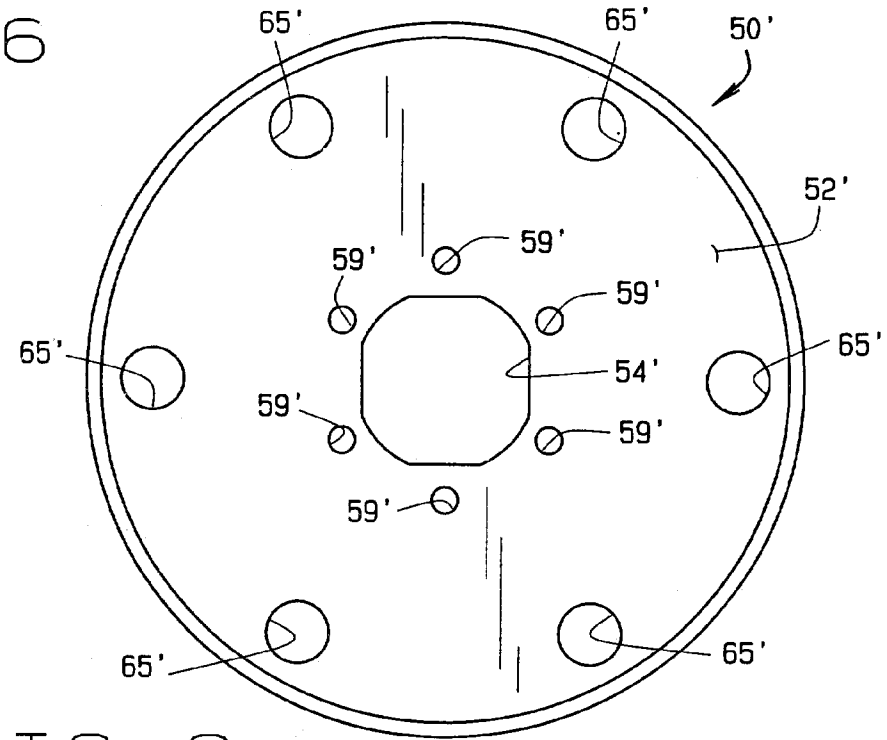
FIG. 8 is a plan view of a support in the form of a center disc which is mountable on the shaft to support hammers in the crusher/shredder.

In FIG. 8, an alternative embodiment of the support is shown. The support 50' is shown in the form of a center disc having a plate 52' with a central opening 54'. The central opening 54' is substantially identical in shape to the opening 54 of the spider 50 (FIG. 5). The disc 50' includes inner openings 59' through which the rod 60 extends. Six openings 59' are shown, however, more or fewer openings could be provided to accommodate more or fewer rods. The disc 50' also includes outer openings 65' which are evenly spaced about the disk 50' near the periphery of the disc. The openings 65' are sized to receive the shaft 66 upon which the hammers/rings are mounted between adjacent discs 50. Six openings 65' are shown. More or fewer openings 65' could be provided to accommodate more or fewer hammers/rings.

Figure 6:
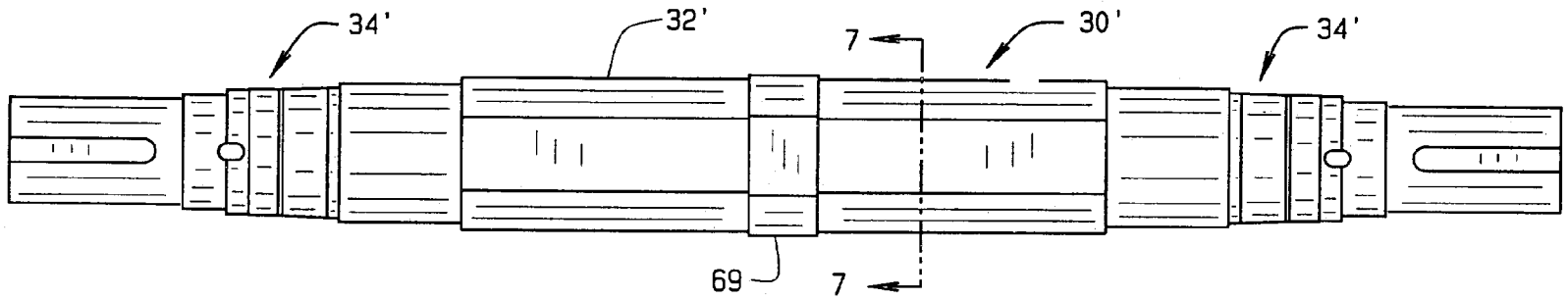
FIG. 6 is a side elevational view of an alternate embodiment of the shaft.
Figure 7:
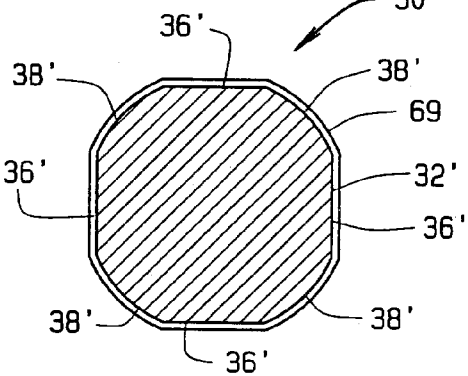
FIG. 7 is a cross-sectional view of the shaft taken along line 7—7 of FIG. 6.

An alternate shaft or rotor 30' is shown in FIGS. 6 and 7. As seen in FIGS. 6 and 7, the rotor 30' includes a multi-sided central section 32' and two cylindrical, stepped end sections 34' extending from opposite sides of the central section. The central section 32', at the approximate center of the rotor 30', includes a raised hub 69 which has the same shape as the center section 32'. As seen in FIG. 7, the central section 32' has eight sides, however, it could be formed with fewer sides or more sides, as desired. The central section 32' as shown in FIG. 7 includes four straight sides 36' which are angled generally 90° to each other and four curved sides 38' positioned between the straight sides 36', and which are also angled generally 90° to each other. The curved sides 38' define arcs of a circle. Thus, in cross-section, the rotor central section 32' can be defined as a circle which is flattened along four sides to form the straight sides 36'. Alternatively, the central section 32' can be defined as a square in which the corners are truncated or beveled; the beveled or truncated sections forming the curved sides 38'. The ends 34' of the rotor 30' extend through openings 40 in the side walls 18 and 20.

Figure 9:
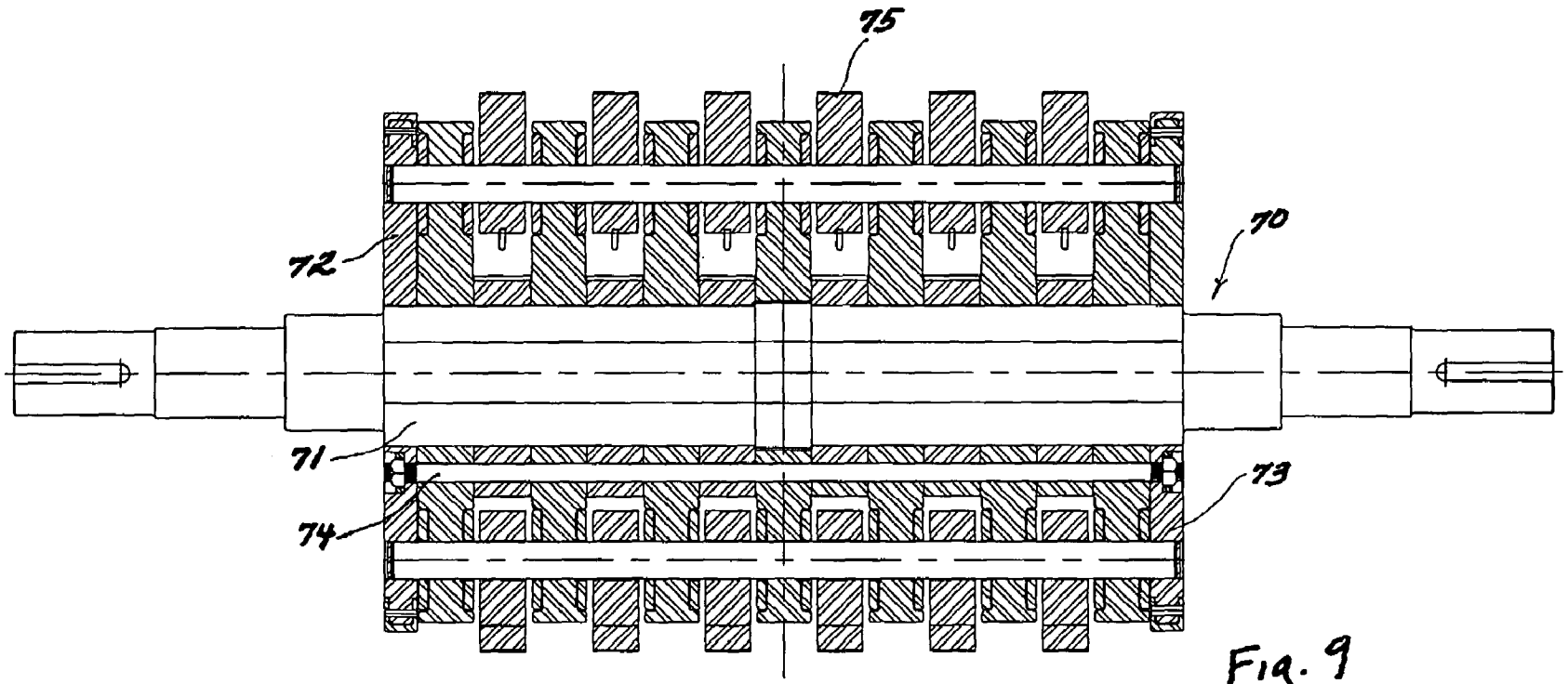
FIG. 9 is a cross sectional view of the crusher modified with respect to the use of the draw bar holds to secure the rotors in place.

The provision of the hub 69 allows for the supports (i.e., the center discs 50' or the spiders 50) to be fixed to the shaft 30' without the use of outer lock nuts to secure or tighten the rotor together. As can be seen at FIG. 9, shaft 70 incorporates its raised center portion 71, and includes a pair of cross bar holds, as at 72 and 73, held by the fasteners 74, to secure the hammers 75 thereon. This holds the entire rotor assembly to the shown shaft. A grate 70*a* (FIGS. 1 and 2) extends from the bottom of the inlet 24 beneath and around the rotor 30 and hammers/rings 64 in a generally arcuate fashion. The grate 70*a*, as can be appreciated, will hold matter to be crushed in the housing to be impacted and crushed by the hammers/rings. As the material is crushed to a desired size, it will fall through the grate 70*a*.

The use of the multi-sided rotor shaft 30, 30' facilitates assembly of the supports 50, 50' and hammers 64 to the rotor 30, as well as operation of the crusher 10. Because the shaft 30, 30' includes the flat sides 36, 36', and the support central openings 54, 54' have the corresponding flat sides, the supports cannot rotate relative to the rotor shaft. Thus, the crusher 10 does not require keys and keyways, pins, bolts, or other fasteners to rotationally fix the supports to the rotor shaft central section 32. Additionally, the corresponding shape of the rotor shaft central section 32 to the support central opening 54, 54' causes the rotor shaft 30 to positively drive the spiders or center discs, and hence the hammers or rings. Again, because there are no keys and keyways, pin, bolts or other fasteners which secure the spiders to the rotor shaft, there are no keys and keyways, pins, bolts, or fasteners which might sheer during operation. Hence, the use of the multi-sided rotor shaft 30, 30', with the supports having central openings corresponding in shape to the cross-sectional shape of the rotor reduces not only the construction costs of the crusher or mill 10, but also reduces maintenance costs of the crusher or mill 10.

As various changes could be made in the above constructions without departing from the scope of the invention, it is intended that all matter contained in the above description or shown in the accompanying drawings shall be interpreted as illustrative and not in a limiting sense. For example, although the rotor 30,30' and the support central opening 54, 54' are both shown to have at least two flat sides, both could be provided with a single flat side. This single flat side would still allow for the support to be rotationally fixed to the shaft or rotor without the use of keys, pins, etc. This example is merely illustrative.

We claim:

1. A crusher machinery in the category of a shredder, crusher, hammer mill or ring mill, said crusher machinery having a housing, a shaft, a shaft support structure incorporated in the housing for holding said shaft in position for rotation therein, said shaft being symmetric in cross section and having at least three sides connecting without right angle corners, and being capable of holding at least a pair of spaced apart supports thereon, each of said spaced apart supports having a central opening of similar shape in cross section as said shaft thus admitting said shaft through each of said supports, said shaft and each of said central openings cooperating to prevent relative rotation of each of said spaced apart supports upon said shaft during usage, said spaced apart supports capable of holding one of a hammer or ring between said spaced apart supports, said shaft including a raised hub having the same number of sides as said shaft, said raised hub being configured to fix said supports upon said shaft without the use of locknuts, said crusher machinery including at least one hammer shaft that passes through said spaced apart supports, with each hammer or ring being pivotally mounted to said hammer shaft between said pair of supports, integral extensions projecting from either end of said shaft, said extensions being circular in configuration and provided for mounting for rotation of said shaft within the shaft support structure of the crusher machinery, a series of rods extending transversely through the supports, to hold said supports together during rotation of said shaft and its hammer and rings of the crusher machinery, each of said rods having opposed threaded ends, at least two spaced apart bars located outwardly adjacent of the two outermost of said supports and centered upon said shaft, said bars having countersunk holes to admit said rods and to receive fasteners, said fasteners, said rods, and said bars cooperating to secure said supports upon said shaft by compression, and said fasteners and the holes in said bars cooperating so that said bars present an outwardly flush surface, and an arcuate grate provided beneath said shaft and its mounted spaced apart supports and hammers and rings, said grate provided for holding any material to be crushed in the housing when impacted by the hammer and rings during usage of the crusher machinery.

2. The crusher machinery of claim 1 wherein said raised hub is generally centered upon said shaft.

3. The crusher machinery of claim 1 and wherein said spaced apart supports are formed as spiders and extend equally to either side of said shaft.

4. The crusher machinery of claim 1 wherein said spaced apart supports are disk shaped, each disk shaped spaced apart support having a series of openings provided therein, said openings provided for accommodating hammer shafts therethrough, and upon which the hammers are mounted between the adjacent ports during usage of the crusher machinery, and each disk also having further openings provided therein, and said further openings provided for accommodating rods for fixing of the spaced apart supports onto said shaft.

* * * * *